US009297208B2

(12) United States Patent
Hansen

(10) Patent No.: US 9,297,208 B2
(45) Date of Patent: Mar. 29, 2016

(54) BALL AND SOCKET ROLLER REAMER AND KEYSEAT WIPER

(71) Applicant: Utah Valley University, Orem, UT (US)

(72) Inventor: Sheldon Hansen, Herriman, UT (US)

(73) Assignee: Utah Valley University, Orem, UT (US)

( * ) Notice: Subject to any disclaimer, the term of this patent is extended or adjusted under 35 U.S.C. 154(b) by 503 days.

(21) Appl. No.: 13/692,901

(22) Filed: Dec. 3, 2012

(65) Prior Publication Data

US 2013/0126244 A1 May 23, 2013

Related U.S. Application Data

(63) Continuation-in-part of application No. 13/683,844, filed on Nov. 21, 2012, now abandoned.

(60) Provisional application No. 61/565,732, filed on Dec. 1, 2011, provisional application No. 61/562,272, filed on Nov. 21, 2011.

(51) Int. Cl.

| | |
|---|---|
| ***E21B 10/08*** | (2006.01) |
| ***E21B 10/26*** | (2006.01) |
| ***E21B 33/08*** | (2006.01) |
| ***E21B 10/30*** | (2006.01) |

(52) U.S. Cl.

CPC ..... *E21B 10/08* (2013.01); *E21B 10/26* (2013.01); *E21B 10/30* (2013.01); *E21B 33/08* (2013.01)

(58) Field of Classification Search

CPC ..... E21B 17/1078; E21B 10/26; E21B 10/30; E21B 37/02; E21B 10/34; E21B 33/08

See application file for complete search history.

(56) References Cited

U.S. PATENT DOCUMENTS

| | | | | |
|---|---|---|---|---|
| 1,664,283 | A * | 3/1928 | Boynton | 166/102 |
| 1,762,504 | A * | 6/1930 | Bull | 175/319 |
| 1,844,371 | A * | 2/1932 | Santiago | 175/345 |
| 1,893,224 | A * | 1/1933 | Carlson | 175/273 |
| 2,079,449 | A * | 5/1937 | Haldeman | 175/203 |
| 2,122,763 | A | 7/1938 | Smith, Jr. et al. | |
| 2,189,032 | A | 2/1940 | Carlton | |
| 2,189,038 | A | 2/1940 | Jones | |
| 2,190,350 | A * | 2/1940 | Catland | 175/346 |
| 2,328,735 | A | 9/1943 | Miller | |
| 2,716,020 | A | 8/1955 | Blaker | |
| 2,742,264 | A | 4/1956 | Snyder | |
| 2,821,363 | A * | 1/1958 | Van Note, Jr. | 175/295 |
| 2,904,313 | A * | 9/1959 | Wisenbaker | 175/406 |
| 3,056,637 | A | 10/1962 | Shanley et al. | |
| 3,306,381 | A | 2/1967 | Garrett et al. | |

(Continued)

FOREIGN PATENT DOCUMENTS

EP 159410 A * 10/1985

*Primary Examiner* — Daniel P Stephenson

(74) *Attorney, Agent, or Firm* — Kenneth E. Horton; Kirton McConkie

(57) ABSTRACT

Exemplary drill tools for placement in a drill string may include a body; a plurality of reamer cutters; and a plurality of ball and socket connectors configured to attach the plurality of reamer cutters to the body. Each of the plurality of reamer cutters may be replaceable by removing at least one of the plurality of ball and socket connectors from the reamer body. Each of the ball and socket connectors may be attached to the reamer body with bolts. Each of the ball and socket connectors may include titanium dioxide and/or titanium carbide coatings where the connectors interface with the reamer cutters.

16 Claims, 6 Drawing Sheets

(56) References Cited

U.S. PATENT DOCUMENTS

| | | | | | |
|---|---|---|---|---|---|
| 3,420,323 | A | * | 1/1969 | Owens | 175/323 |
| 3,431,990 | A | * | 3/1969 | Webb | 175/295 |
| 3,642,079 | A | * | 2/1972 | Van Note | 175/325.2 |
| 3,659,663 | A | | 5/1972 | Dysart | |
| 3,719,241 | A | | 3/1973 | Bell | |
| 3,747,700 | A | * | 7/1973 | Rilling | 175/227 |
| 3,818,999 | A | | 6/1974 | Garrett | |
| 3,820,613 | A | | 6/1974 | White | |
| 3,866,695 | A | | 2/1975 | Jackson | |
| 3,907,048 | A | | 9/1975 | Gray | |
| 3,916,998 | A | * | 11/1975 | Bass et al. | 166/301 |
| 3,917,361 | A | | 11/1975 | Murdoch | |
| 3,980,309 | A | | 9/1976 | Dechavanne | |
| 4,013,325 | A | | 3/1977 | Rear | |
| 4,182,425 | A | | 1/1980 | Garrett | |
| 4,261,426 | A | | 4/1981 | Garrett | |
| 4,262,760 | A | | 4/1981 | Allison et al. | |
| 4,330,043 | A | * | 5/1982 | Sheffield et al. | 175/406 |
| 4,479,538 | A | * | 10/1984 | Coyle, Sr. | 166/173 |
| 4,499,642 | A | | 2/1985 | Vezirian et al. | |
| 4,508,184 | A | | 4/1985 | Hansen | |
| 4,526,387 | A | | 7/1985 | Flower | |
| 4,548,284 | A | | 10/1985 | Shinn et al. | |
| 4,561,508 | A | | 12/1985 | Garrett | |
| 4,664,206 | A | * | 5/1987 | Butler | 175/325.2 |
| 5,381,868 | A | | 1/1995 | Schock | |
| 6,223,840 | B1 | * | 5/2001 | Swietlik | 175/323 |
| 7,954,566 | B2 | * | 6/2011 | Yao | 175/325.2 |
| 8,336,645 | B2 | * | 12/2012 | Robson et al. | 175/323 |
| 8,607,900 | B1 | * | 12/2013 | Smith | 175/394 |
| 2004/0060699 | A1 | * | 4/2004 | Rastegar | 166/285 |
| 2004/0195009 | A1 | * | 10/2004 | Boulet | 175/325.1 |
| 2010/0326738 | A1 | * | 12/2010 | Boulet | 175/324 |
| 2013/0126244 | A1 | * | 5/2013 | Hansen | 175/84 |
| 2013/0199858 | A1 | * | 8/2013 | Hansen | 175/406 |

* cited by examiner

BALL AND SOCKET ROLLER REAMER AND KEYSEAT WIPER

PRIORITY

This application is a continuation-in-part of U.S. patent application Ser. No. 13/683,844 filed on Nov. 21, 2012, entitled KEYSEAT WIPER, which claims the benefit of United States Provisional Patent Application No. 61/562,272 filed on Nov. 21, 2011, entitled KEYSEAT WIPER, the disclosures of which are incorporated herein by reference in their entireties. This application also claims benefit of U.S. Provisional Patent Application No. 61/565,732 filed on Dec. 1, 2011, entitled BALL AND SOCKET ROLLER REAMER, the disclosure of which is also incorporated herein by reference in its entirety.

FIELD

This application relates generally to tools for drill strings and methods of making and using such tools. In particular, this application relates to ball and socket roller reamers and keyseat wipers for use with drill rods that are used in exploratory and production drilling, as well as methods for making and using such ball and socket roller reamers and keyseat wipers.

BACKGROUND

In a conventional process used in drilling, an open-faced drill bit is attached to a drill string, which is a series of connected drill rods and tools that are assembled section by section as the drill string moves deeper into a formation during a drilling operation. During drilling operations, the walls of the borehole sometimes become marred or deformed for a variety of reasons. For example, boreholes may develop doglegs, key seats, and ledges during normal drilling operations that tend to bind and damage drill strings and tools. For example, during drilling operations, the drill string sometimes deviates from directly vertical, making at slightly arced path through the formation being drilled. In such cases, withdrawing a drill string from the borehole can be problematic as the drill string can bind against the curved wall of the bore hole. In particular, the pipe connections of the drill string, being wider at the connections than the pipe lengths, tends to dig into the side wall of the borehole creating what is known as a keyseat.

Attempts to work the drill string loose can case the borehole to deform and even collapse, causing additional problems with the drilling. In extreme circumstances, portions of the drill string may be damaged or destroyed while being withdrawn from the borehole. Reamers and keyseat wipers have been used to maintain the condition of the sidewalls of boreholes and to stabilize the drill string in the borehole during drilling operations. Reamers generally use replaceable blocks and rollers in three or four locations around the reamer tool, as the blocks and rollers tend to become worn during drilling operations. Replacing blocks and rollers in reamer tools can be very difficult and time consuming as the blocks are generally pounded into place in slots in the tool and held from sliding by a bolt or pin. Additionally, traditional roller reamers include a shaft passing through the center of the reamer cutter around which the reamer cutter rotates. The creates the necessity of securing the shaft securely at both ends, necessitating the blocks that are pounded into place.

SUMMARY

Embodiments of roller reamer and keyseat wiper tools for use in drilling processes, as well as methods for making and using such tools, are described herein. Exemplary tools for placement in a drill string may include a body; a plurality of reamer cutters; and a plurality of ball and socket connectors configured to attach the plurality of reamer cutters to the body, wherein the plurality of ball and socket joints are configured to permit rotation of each of the plurality of reamer cutters.

Each of the plurality of reamer cutters may be replaceable by removing at least one of the plurality of ball and socket connectors from the reamer body. Each of the ball and socket connectors may be attached to the reamer body with bolts. Each of the ball and socket connectors may include titanium dioxide and/or titanium carbide coatings where the connectors interface with the reamer cutters.

In some embodiments, tools may include a first tapered section tapering from a first diameter to a second larger diameter; a wiper section having the second larger diameter; a second tapered section tapering from the second larger diameter to the first diameter; and a reduced section in the wiper section, the reduced section having a diameter smaller than the second larger diameter. The wiper section may include reamers cutters.

In other embodiments, the first tapered section and the second tapered section may each include flutes, the flutes of the first tapered section being rotationally offset from the flutes of the second tapered section. In other embodiments, the tool may further include at least one outside reduced section located adjacent to the first diameter of the first tapered section. In some embodiments, exemplary tools can include changing cross-sections and a relief sections that permit cut materials to pass by the tool, reducing the possibility of a drill string with the tool in place from binding in a curved hole when being retrieved.

BRIEF DESCRIPTION OF THE DRAWINGS

The following description can be better understood in light of Figures, in which.

Figure 1:
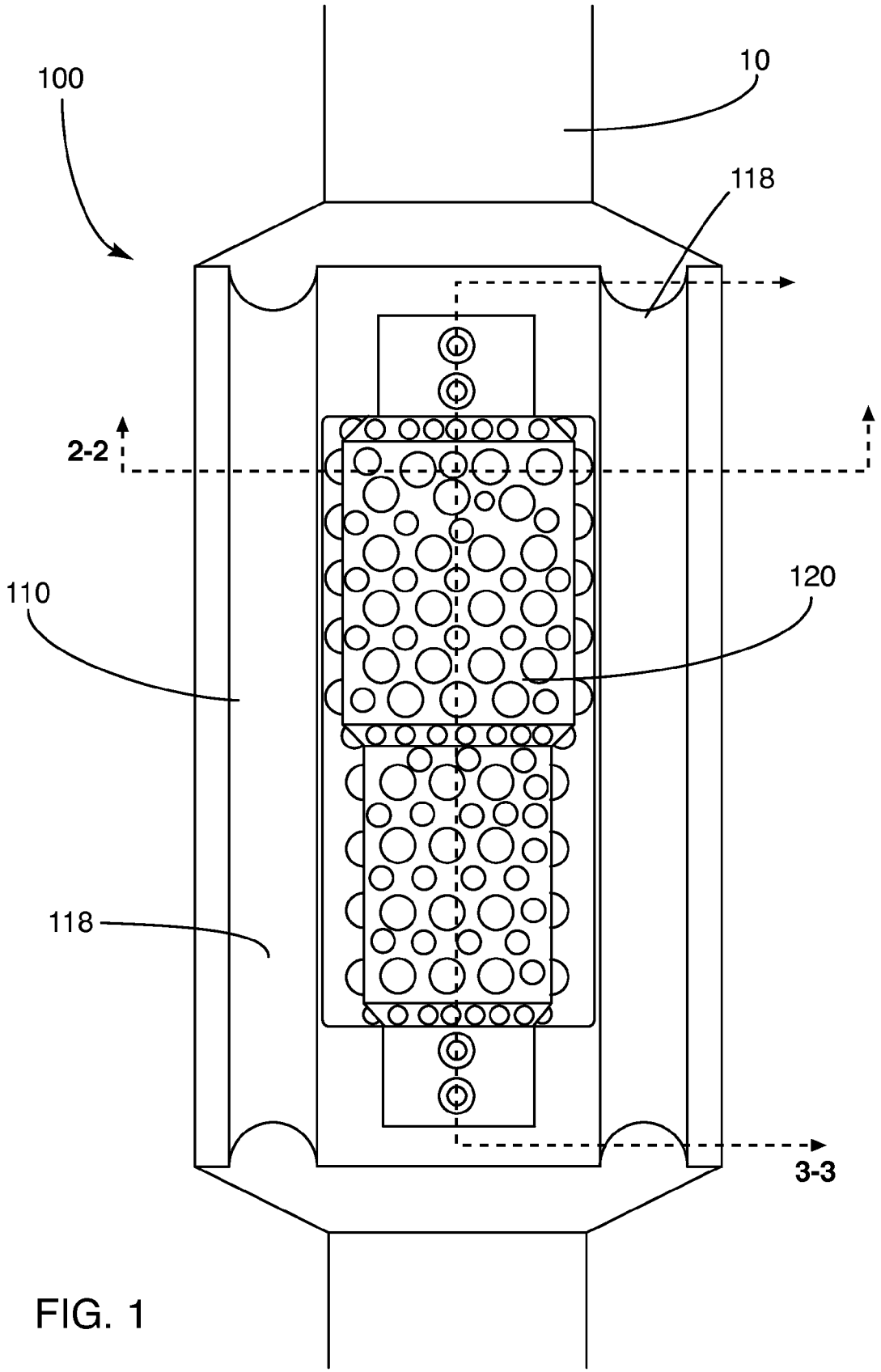
FIG. 1 illustrates an exemplary, side view of a roller reamer tool.

Together with the following description, the Figures demonstrate and explain the principles of the roller reamer and keyseat wiper tools and methods for using such tools. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below includes examples of rotary drilling, the apparatus and associated methods could be equally applied in other drilling process, such as core drilling, percussive drilling, and exploratory drilling, as well as other drilling procedures and systems. Indeed, the apparatus and associated methods could be used in any type of drilling process where a drill string may alter to a curved or arced borehole. And the term "drill rod" will be taken to include all forms of elongate members used in the drilling, installation and maintenance of bore holes and wells in the ground and will include rods, pipes, tubes and casings which are provided in lengths and are interconnected to be used in a borehole.

The drill string reamer and keyseat wiper tools described in this application can have any configuration consistent with their operation described herein. Reamer and keyseat wiper tools may be designed such that cutters clear passageways for a drill string to be withdrawn from an arced borehole without binding in the borehole. Reamer tools may include a body and cutters connected to the body with connectors.

One exemplary configuration of a reamer tool 100 is illustrated in FIGS. 1-4. The reamer tool 100 may a roller reamer and be designed such that the reamer cutters 120 clear passageways for a drill string to be withdrawn from an arced borehole without binding in the borehole. Roller reamer tools 100 may include reamer body 110 and reamer cutters 120 connected to reamer body 110 with ball and socket connectors 130.

The roller reamer tool 100 may be included in a drill string 10 to maintain a desired borehole dimension. The reamer cutters 120 may be able to cut away excess portions of a borehole wall to provide the desired dimension. The reamer cutters 120 may be able to rotate with respect to the reamer body 110 such that when the roller reamer tool 100 is being used, the reamer cutters 120 may press against the borehole walls and rotate as the entire drill string is rotated as part of the drilling process. As such, the cutting inserts 122 may press and grind against the borehole wall while the cutters 120 are able to rotate freely to facilitate the rotating drill string 10 within a borehole.

In some embodiments, the reamer body 110 may include fluted sections 118 to allow cut material from the borehole and cutting fluid to pass by the outside of the roller reamer tool even when engaged with the borehole walls. The reamer body 110 may have an outside diameter slightly smaller than the desired diameter of the borehole, and larger than couplings in the drill string 10, such that the roller reamer tool 100 fits easily within to borehole while providing borehole dimension maintenance for the drill string 10. Reamer body 110 may also include center passageway 150 for the passage of drilling fluid 20 down to the cutting head of the drill string 10. Reamer body 110 may be formed of any suitable material used in the industry and/or coated with any coating used in the industry for durability, hardness, lubrication, etc.

Figure 2:
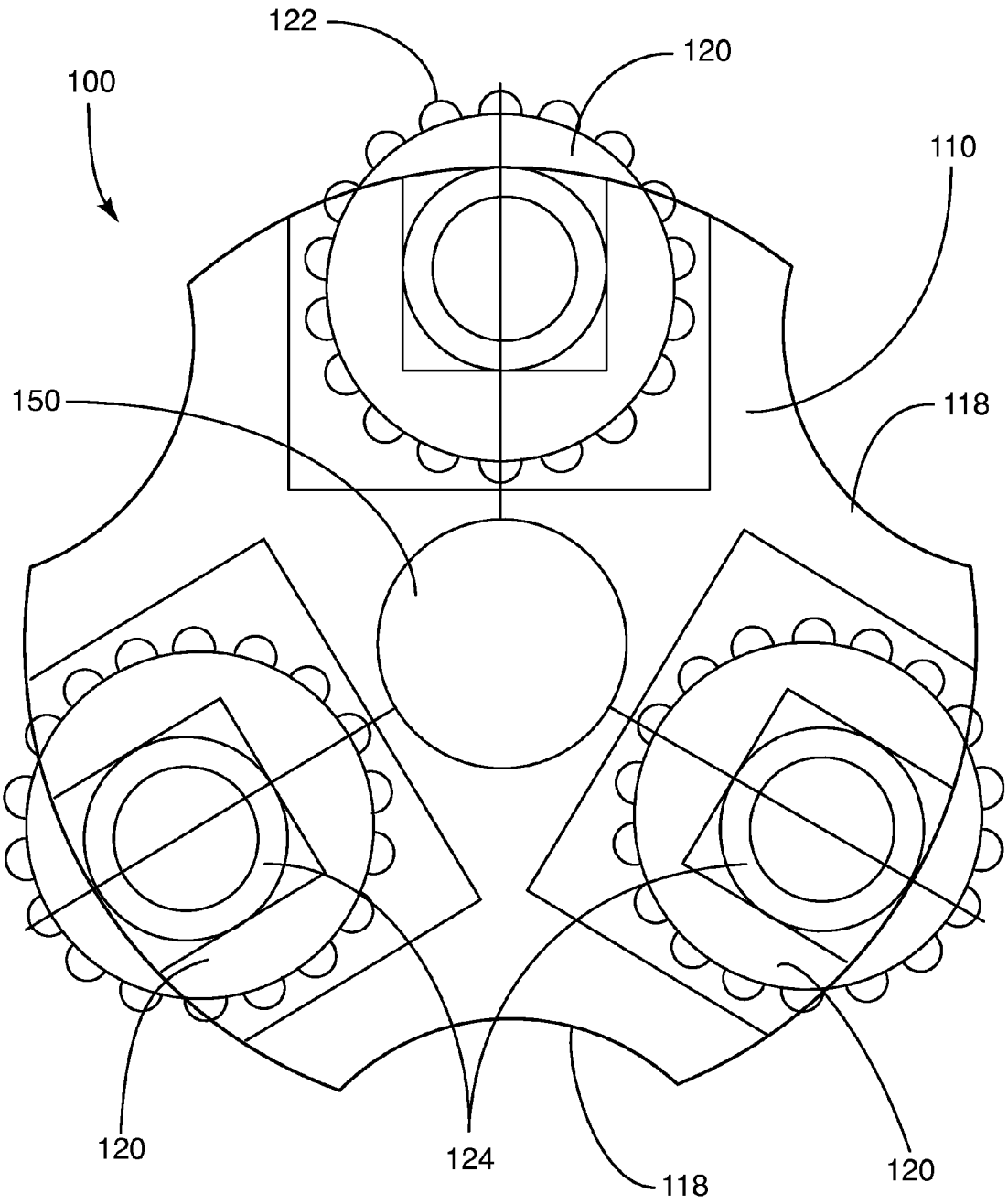
FIG. 2 illustrates a cross-sectional view of a section of the roller reamer tool of FIG. 1 taken along section line 2-2.

As best shown in FIG. 2, reamer cutters 120 may be included at spaced intervals around the roller reamer tool 100. In the illustrated embodiments, three reamer cutters 120 are shown spaced evenly around the roller reamer tool 100. However, in other embodiments, two, four, or more reamer cutters 120 may be included on the periphery of the roller reamer tool 100. Reamer cutters 120 are able to rotate about a central axis such that when the drill string 10 rotates in the borehole, the roller reamer tool 100 is able to rotate within the borehole and the reamer cutters 120 engage with the borehole walls with minimal rotational friction.

The rotational axis of each of the reamer cutters 120 may be such that only a small arc of the reamer cutter 120 extends beyond the outer diameter of the reamer body 110. Reamer cutters 120 may be any style of conventional reamer cutters with cutting flutes, cutting inserts 122, as shown in the figures, or other configurations. For example, the reamer cutters 120 are shown having a step with two different outer diameters in different sections of the reamer cutters, but reamer cutters may have an unstepped outer diameter (such as the reamer cutter 220 shown in FIG. 5), a lenticular shape, or a sloped or conical shape providing different outer diameters and different positions along the reamer cutter.

The cutting inserts 122 may be any shape or size used in the industry and may be formed of any appropriate material. The cutting inserts 122 may be formed of a hard material, such as tungsten carbide or tool steel, to reduce wear as the reamer cutters press against the interior of a borehole. The cutting inserts 122 may further provide additional tool life to the other components of the reamer cutter 100 by taking the brunt of the impact and wear as the reamer cutter tool 100 is used. Similarly, the cutting inserts 122, the reamer cutters 120, and other various surfaces of the reamer cutters 120 and reamer body 110 may include an additional abrasive coating, or may be formed from a material for cutting (such as cut-rite) for assisting in cutting the materials away from the borehole wall where appropriate and to improve tool life.

Figure 3:
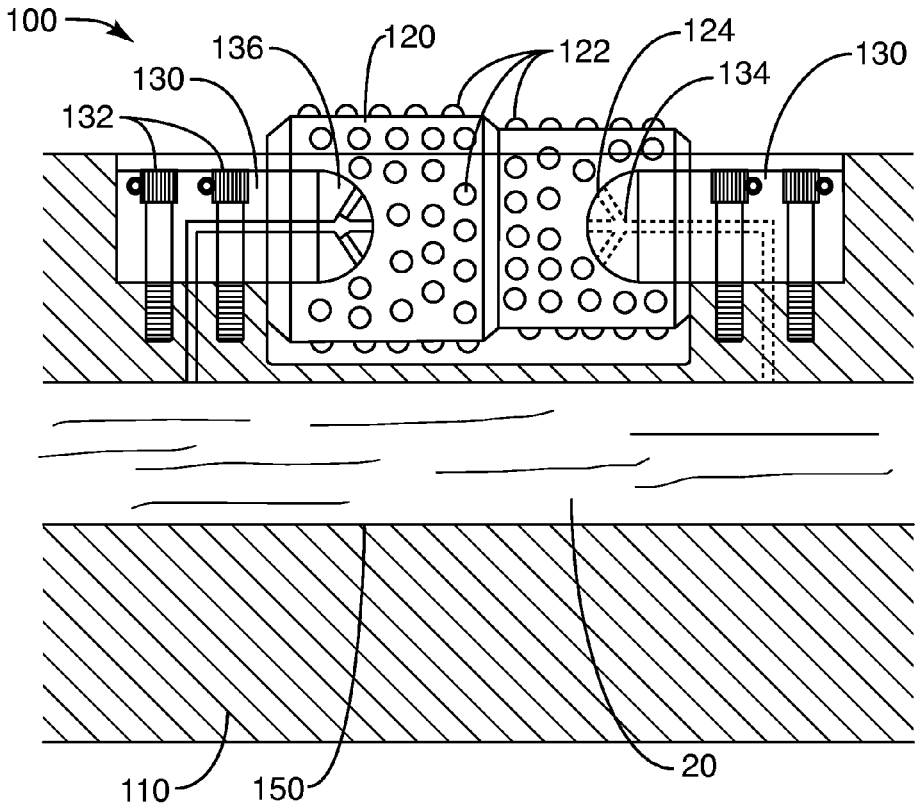
FIG. 3 illustrates a cross-sectional view of a section of the roller reamer tool of FIG. 1 taken along section line 3-3.
Figure 4:
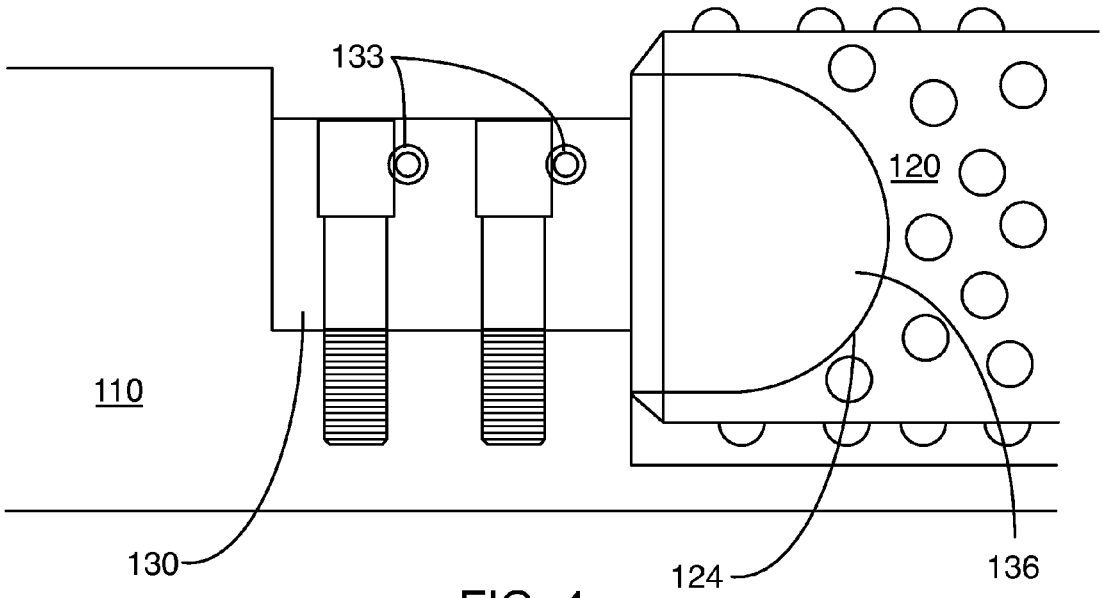
FIG. 4 illustrates a further detailed cross-sectional view of the roller reamer tool of FIG. 1, including a detailed look at an exemplary ball and socket joint.

As shown in FIGS. 3 and 4, the reamer cutters 120 may be attached to the reamer body 110 with ball and socket connectors 130, which may be easily removed to replace worn or broken parts of the roller reamer 100. Replacing blocks and rollers in traditional reamer tools can be very difficult and time consuming as the blocks are generally pounded into place in slots in the tool and held from sliding by a bolt or pin. Additionally, traditional roller reamers include a shaft passing through the center of the reamer cutter around which the reamer cutter rotates. This can create the necessity of securing the shaft securely at both ends, requiring the blocks to be pounded into place, which makes them difficult to pound out of place.

The ball and socket connectors 130 of the exemplary embodiments may eliminate the need for a shaft passing through the center of the reamer cutters 120 and facilitate changing worn components. The socket connectors 130 may be held in place in the reamer body 110 with bolts 132 to provide an easy way to remove worn components. Bolts 132 may be standard hardened machine bolts of an appropriate size (for example, #6, #8, etc.) and may be additionally secured with lock pins 133 to keep them from loosening during drilling operations. Because an operator only needs to remove a few bolts to change reamer cutter 120, repairing roller reamer 110 and replacing reamer cutters 120 is significantly easier than with traditional blocks and reamer cutters with a center shaft.

The socket connectors 130 may include a ball end 136 that interfaces with corresponding sockets 124 of the reamer cutters 120. As such, the reamer cutters 120 may be solid with pockets (sockets) 124 formed at each end to interface with the ball end 136 of the connectors 130. In some embodiments, the reamer cutters 120 may by cylindrical with a channel extending through the center that can also accommodate and interface with the ball ends 136. The mating surfaces of ball end 136 and socket 124 may be coated with titanium dioxide or titanium carbide, or some other hard coating, to reduce wear as reamer cutters 120 rotate. Additionally, in some embodiments, the socket connectors 130 may include fluid channels 134 from the center passageway 150 to allow drilling fluid 20 to lubricate the mating surfaces to extend the tool life.

Figure 5:
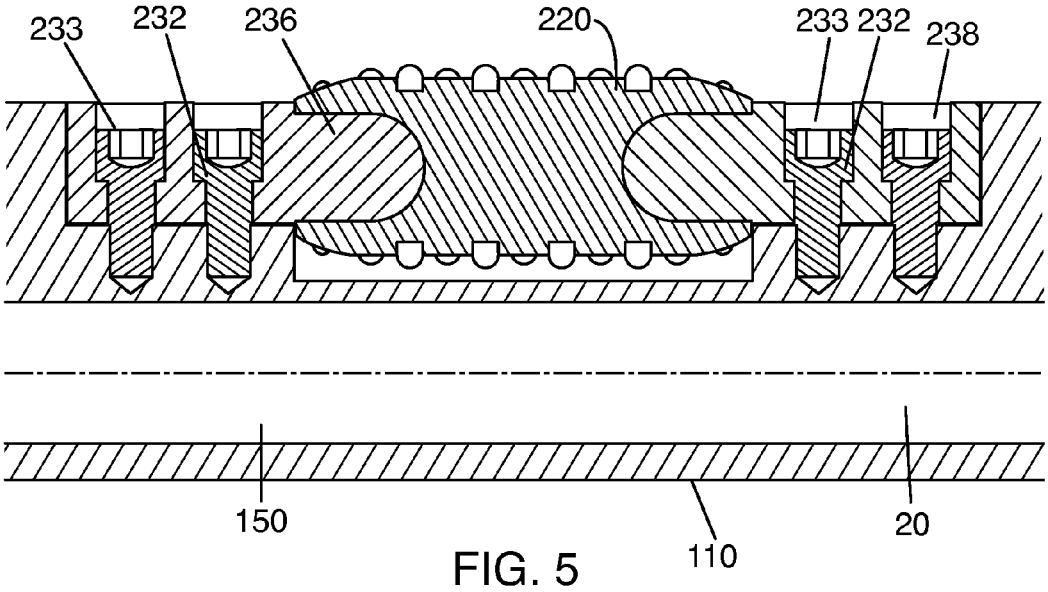
FIG. 5 illustrates a partial cross-sectional view of an exemplary roller reamer tool.

Turning now to FIG. 5, other embodiments of a reamer cutter 220 may include sockets 224 and ball ends 236 in socket connectors 230 similar to the sockets 124 and the socket connectors 130 of the embodiments illustrated in FIGS. 1-4 and discussed above. The reamer cutter 220 may generally have a single outer diameter instead of a stepped outer diameter as illustrated with respect to the reamer cutter 120. Additionally, the bolts 232 securing the socket connectors 230 to the reamer body 110 may be held in place using lock rings 233 instead of pins. The lock rings 233 may be held in a groove within the bolt holes 238 in the socket connectors 230 to prevent the bolts 232 from loosening due to vibrations during drilling operations.

Figure 6:
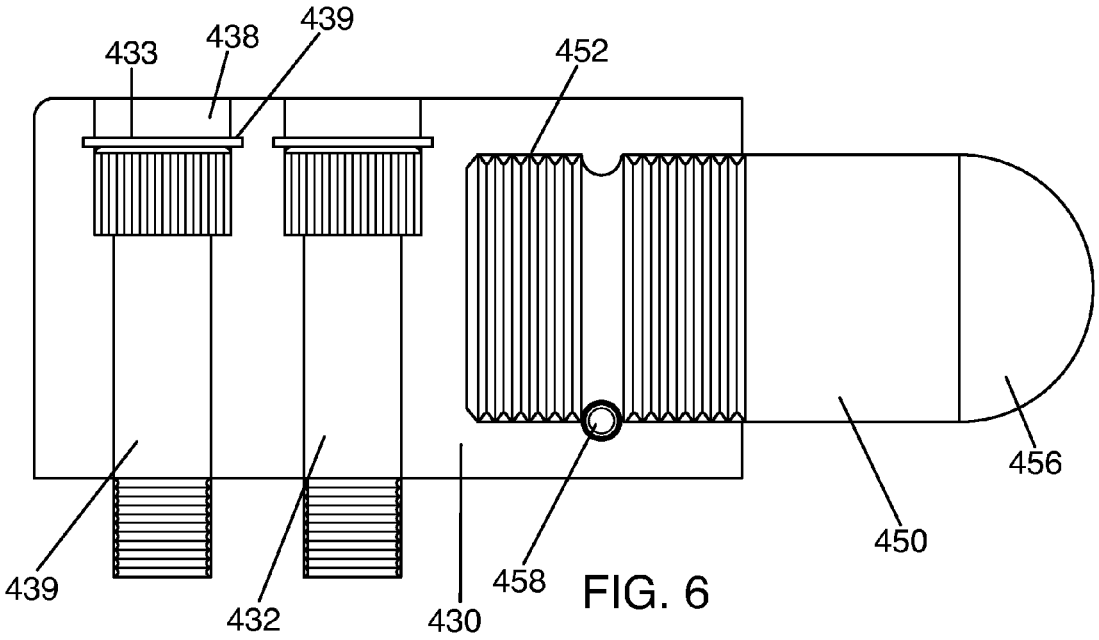
FIG. 6 illustrates a partial cross-sectional view of an exemplary ball and socket joint for an exemplary roller reamer or roller reamer and keyseat wiper tool.

FIG. 6, illustrates other embodiments of a socket connector 430, including a removable ball end 450 with ball 456. Because the ball 456 experiences wear and friction against the pocket of the reamer cutter, the ball 456 will generally become worn long before the rest of the socket connector 430. The ball end 450 may be removably coupled to the socket connector 430 by a threaded connection 452 to allow worn ball ends 450 to be replaced without having to replace the entire socket connector. The ball end 450 may be secured with a pin 458 to prevent vibrational loosening of the threaded connection 452 when in use. The pin 458 may be prevented from sliding out by the adjacent walls of the reamer body 110 when the socket connector is in place.

Similarly to the embodiments shown in FIG. 5, the bolts 432 holding the socket connector 430 may be secured using lock rings 433 engaged in grooves 439 of the bolt holes 438 in the socket connector 430. Thus, in order to replace a worn ball end 450, the lock rings 433 may be removed, followed by the bolts 432, which then allows the socket connector 430 to be pulled out of the reamer body along with reamer cutter. Once out of the reamer body, the pin 458 securing the threaded connection 452 between the ball end 450 and the socket connector 430 may be removed and the ball end 450 may then be unscrewed from the socket connector 430 and replaced, potentially saving money over replacing the entire socket connector.

In other embodiments, one end of the reamer cutter may be held with a socket connector that is pinned to the reamer body instead of the bolted down, which may allow the reamer cutter and the socket connector attached to the other end of the reamer cutter to rotate away from the reamer body. The socket connector and reamer cutter may then rotate about the pin holding the pinned socket connector when the bolts holding the second socket connector are removed. In such a configuration, the effort required to change reamer cutters may be even less than with both socket connectors 130 bolted to the reamer body 110. Similarly, in some embodiments, the ball end may be on the reamer cutter and the socket may be on the socket connector instead of the ball end being on the socket connector and the socket being on the reamer cutter.

Figure 7:
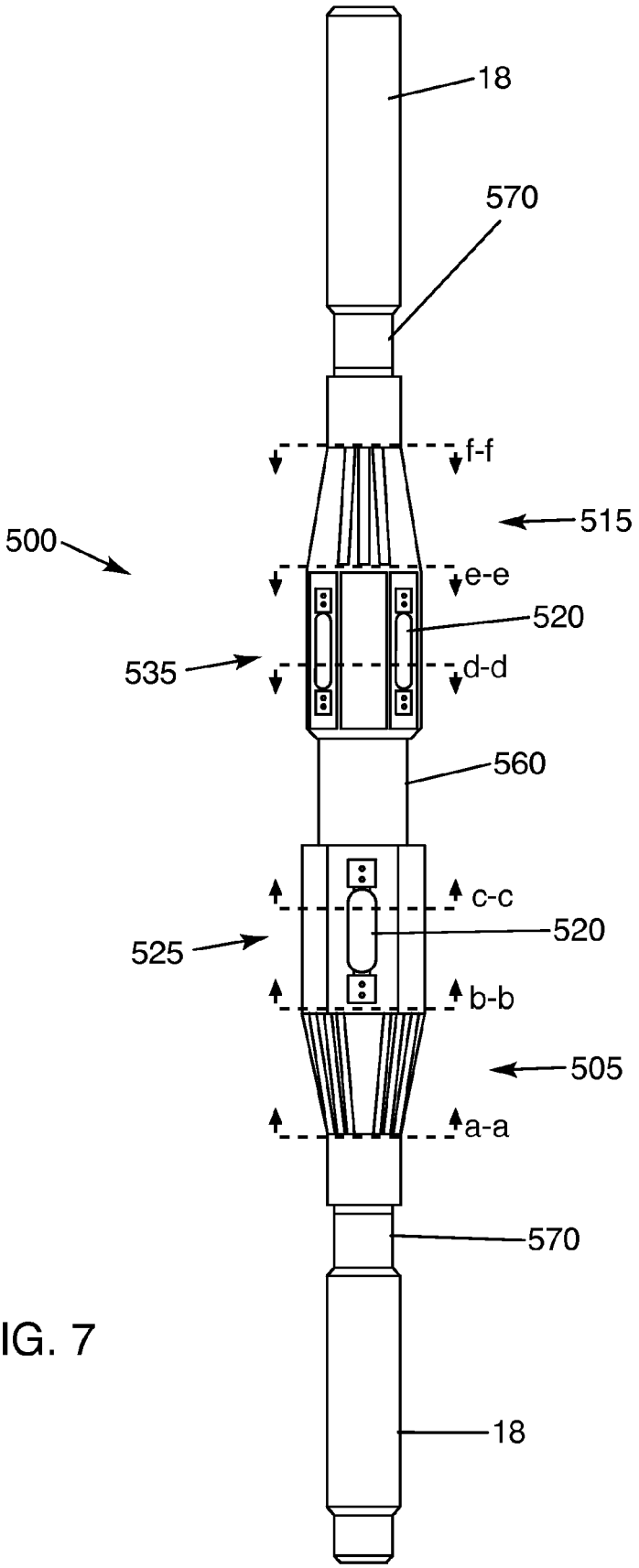
FIG. 7 illustrates a side view of an exemplary roller reamer and keyseat wiper tool.

Turning now to FIG. 7, reamer cutters 520 may be incorporated into a keyseat wiper tool 500. Reamer cutters 520 may include any of the features described above with respect to the reamer cutters and socket connectors discussed above. Keyseat wiper tool 500 may include different cross sectional configurations to cut and create passageways for a drill string to be withdrawn from an arced borehole, thereby removing keyseats which may be formed in the borehole during drilling operations. Some prior art has provided keyseat reamers that encourage the drill string to exit the borehole without binding against the inner walls by cutting the keyseat to the width of the pipe connections. U.S. Pat. No. 4,330,043 includes a detailed description of the problem caused by keyseat formation and proposes a solution. However, the solution of the '043 patent suffers from cut materials collecting in the flutes and binding the tool in the borehole as the excess cut materials have no way of passing by the keyseat wiper or being removed. To solve this problem, relief sections 560, 570, may be provided in some embodiments with a narrower cross-sectional thickness to permit material cut by the keyseat wiper tool to aggregate and then fall past the relief sections down the borehole, solving the problems of conventional keyseat wipers.

Figure 8A:
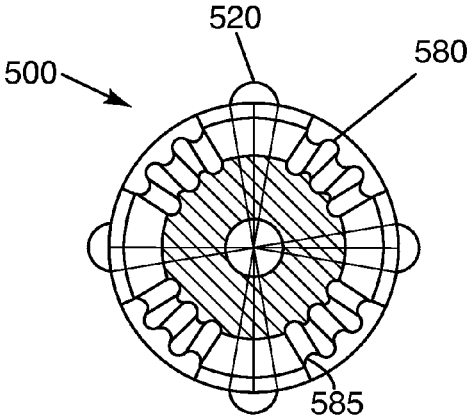
FIG. 8*a* illustrates a cross-sectional view of the roller reamer and keyseat wiper tool of FIG. 7 taken along section line a-a.
Figure 8B:
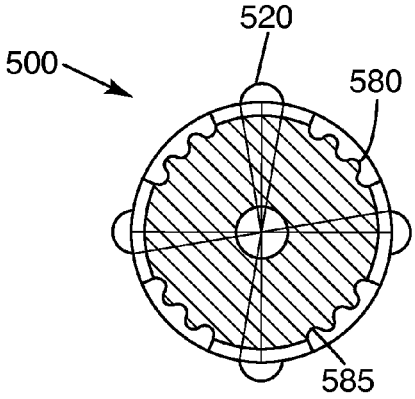
FIG. 8*b* illustrates a cross-sectional view of the roller reamer and keyseat wiper tool of FIG. 7 taken along section line b-b.
Figure 8C:
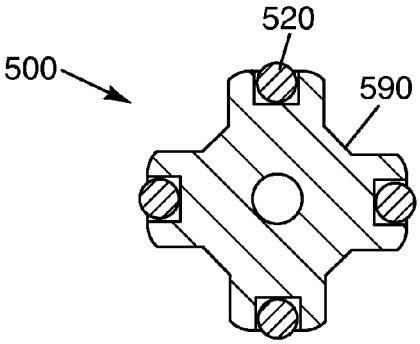
FIG. 8*c* illustrates a cross-sectional view of the roller reamer and keyseat wiper tool of FIG. 7 taken along section line c-c.
Figure 8D:
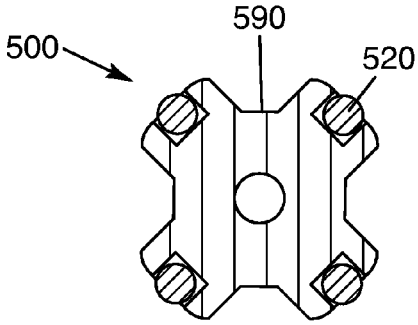
FIG. 8*d* illustrates a cross-sectional view of the roller reamer and keyseat wiper tool of FIG. 7 taken along section line d-d.
Figure 8E:
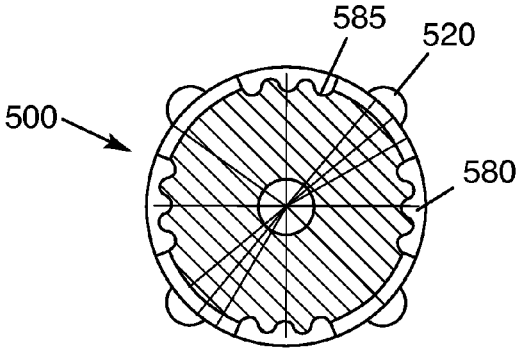
FIG. 8*e* illustrates a cross-sectional view of the roller reamer and keyseat wiper tool of FIG. 7 taken along section line e-e.
Figure 8F:
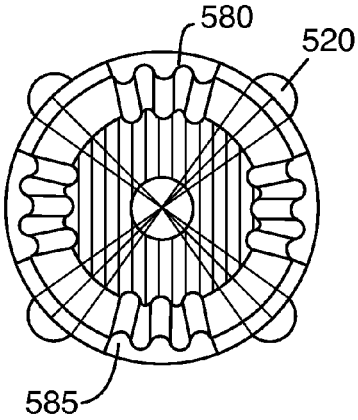
FIG. 8*f* illustrates a cross-sectional view of the roller reamer and keyseat wiper tool of FIG. 7 taken along section line f-f.

Additionally, different cutting sections may be provided to facilitate removing keyseats. FIGS. **8*a*-8*f* illustrate various cross sections which may be provided in the keyseat wiper tool 500. FIG. 8*a* corresponds to cross-section a-a, FIG. 8*b* to cross-section b-b, and so forth to FIG. 8*f*, which corresponds to cross-section f-f. It should be understood that the different cross sectional views may transition into each other. As can be seen, different ends of the cutting section between sections a-a and f-f may be generally symmetric, but at a different rotational position such that the flutes 590** may not align linearly with each other from section to section. For example, cross-section a-a may be similar to f-f, and cross-section b-b may be similar to cross section e-e, and cross-section c-c may be similar to cross-section d-d, except that the corresponding sections may be rotated. For example, as shown in the figures, the features of cross-section c-c may be rotationally different from the features of cross-section d-d by about 45 degrees. The rotated features allow cut materials to pass to the bottom of the borehole while providing a more consistent overall diameter to reduce potential binding should the cutting flutes attempt to cut too much material. In some embodiments, the different ends of the cutting section between sections a-a and f-f may vary, depending on the desired use, soil type, and drilling configuration. As such, the cutting tapers and profiles of the various sections may be provided as desired for particular conditions.

The transition section 505 between cross-sections a-a and b-b, and the transition section 515 between cross-section f-f and e-e, may be tapered to provide a sloped engagement to reduce the amount of cutting that any given section of the keyseat wiper tool 500 may perform. The taper, along with the rotational offset as described, may help force the drill string into the correct alignment with the borehole in harder substrate materials, reducing the amount of time and energy required to withdraw the drill string from the borehole. Thus, transition portions 525 and 535 with cross-sections c-c and d-d, respectively, have a larger diameter than cross-sections b-b and f-f.

As shown in the Figures, the tapered sections between cross-section a-a and b-b and between cross-sections f-f and e-e may include multiple cutting teeth 580 separated by flutes 585 to remove materials from the sidewall. Similarly, cross-sections c-c and d-d may include flutes 590 to permit cut material to move along the keyseat wiper tool 500. Because of the rotated features, the flutes 590 of cross-sections c-c and d-d may be deeper since an extended portion of cross-sections c-c or d-d and the reamer cutters 520 would always be in contact with the side wall of the borehole.

The diameter of cross-sections d-d and c-c may be about the same or slightly smaller than as the desired diameter of the borehole. When the diameter of cross sections d-d and c-c are about the same as the diameter of the borehole, the keyseat wiper tool may serve to effectively guide the drill string out of the borehole without unnecessary cutting by the keyseat wiper or reamer cutters 520. In some embodiments, keyseat wiper tools may be provided without reamer cutters.

Reduced portions 570 may be provided on one or both ends of the tool outside of the tapered section between cross-sections a-a and f-f. The reduced portions 570 may help cut materials to pass by the keyseat wiper tool 500. Similarly, between cross-sections d-d and c-c, a reduced section 560 may be included to allow cut materials collecting in the flutes 590 of cross sections d-d and c-c to loosen and pass along the tool, thus overcoming the problems of compacted cut materials that tend to bind prior reamers and keyseat wipers.

Similar to the reamer tools described above, the various surfaces of the different features of the illustrated cross-sections may include an abrasive coating, or may be formed from a material for cutting (such as cut-rite) for assisting in cutting the materials away from the keyseat wiper tool 500.

In addition to any previously indicated modification, numerous other variations and alternative arrangements may be devised by those skilled in the art without departing from the spirit and scope of this description, and any claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A tool for placement in a drill string, the tool comprising:
a body;
a plurality of reamer cutters; and
a plurality of ball and socket connectors configured to attach the plurality of reamer cutters to the body, wherein the plurality of ball and socket connectors are configured to permit rotation of each of the plurality of reamer cutters, and wherein each of the plurality of reamer cutters comprises a socket formed therein, the socket cooperatively operating with one of the plurality of ball and socket connectors.

2. The tool of claim 1, wherein each of the plurality of reamer cutters is replaceable by removing at least one of the plurality of ball and socket connectors from the body.

3. The tool of claim 1, wherein each of the ball and socket connectors is attached to the body with removable bolts.

4. The tool of claim 1, wherein at least one of the ball and socket connectors is lubricated with drilling fluid.

5. The tool of claim 1, wherein each of the plurality of reamer cutters comprises a plurality of cutting inserts.

6. The tool of claim 1, wherein each of the plurality of ball and socket connectors comprises a coating of titanium dioxide or titanium carbide.

7. The tool of claim 1, wherein each of the plurality of ball and socket connectors comprises a ball end and a socket connector, wherein the ball end is releasably coupled to the socket connector.

8. A tool for placement in a drill string, the tool comprising:
a first tapered distal section tapering from a first diameter to a second larger diameter;
a second tapered proximal section tapering from the second larger diameter to the first diameter;
a central wiper section extending between the first tapered distal section and the second tapered proximal section, the central wiper section having the second larger diameter;
a reduced section in the wiper section, the reduced section having a diameter smaller than the second larger diameter; and
a plurality of roller reamer cutters that are positioned in the wiper section.

9. The tool of claim 8, wherein the first tapered distal section and the second tapered proximal section each include flutes, the flutes of the first tapered distal section being rotationally offset from the flutes of the second tapered proximal section.

10. The tool of claim 8, further comprising at least one outside reduced section located adjacent to the first diameter of the first tapered distal section.

11. The tool of claim 8, wherein the plurality of roller reamer cutters are attached to the tool with a plurality of ball and socket connectors.

12. The tool of claim 11, wherein each of the ball and socket connectors is attached to the tool with removable bolts.

13. The tool of claim 12, where in each of the plurality of roller reamer cutters is replaceable by removing the removable bolts.

14. A tool for placement in a drill string, the tool comprising:
a body;
a plurality of roller reamer cutters; and
a plurality of ball and socket connectors configured to attach the plurality of roller reamer cutters to the body, wherein each of the plurality of ball and socket connectors is connected to the body using removable bolts.

15. The tool of claim 14, wherein the plurality of ball and socket connectors are located in pockets in the body.

16. The tool of claim 15, wherein the plurality of ball and socket connectors are located within a maximum outside diameter of the body.

* * * * *